US009466310B2

(12) United States Patent
Cudak et al.

(10) Patent No.: US 9,466,310 B2
(45) Date of Patent: Oct. 11, 2016

(54) COMPENSATING FOR IDENTIFIABLE BACKGROUND CONTENT IN A SPEECH RECOGNITION DEVICE

(71) Applicant: LENOVO ENTERPRISE SOLUTIONS (SINGAPORE) PTE. LTD., Singapore (SG)

(72) Inventors: Gary D. Cudak, Creedmoor, NC (US); Lydia M. Do, Raleigh, NC (US); Christopher J. Hardee, Raleigh, NC (US); Adam Roberts, Moncure, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 371 days.

(21) Appl. No.: 14/136,489

(22) Filed: Dec. 20, 2013

(65) Prior Publication Data

US 2015/0179184 A1 Jun. 25, 2015

(51) Int. Cl.
*G10L 21/0208* (2013.01)
*G10L 21/0216* (2013.01)

(52) U.S. Cl.
CPC ..... *G10L 21/0208* (2013.01); *G10L 21/0216* (2013.01)

(58) Field of Classification Search
USPC ..... 704/231, 233, 244, 246, 270, 275
See application file for complete search history.

(56) References Cited

U.S. PATENT DOCUMENTS 4,933,973 A * 6/1990 Porter ..... G10L 15/20 704/233
5,848,163 A 12/1998 Gopalakrishnan et al.
5,924,065 A * 7/1999 Eberman ..... G10L 21/0208 704/222
5,970,446 A * 10/1999 Goldberg ..... G10L 15/20 704/233
6,959,276 B2 * 10/2005 Droppo ..... G10L 15/20 379/406.01
7,383,178 B2 6/2008 Visser et al.
8,010,354 B2 8/2011 Otsuka et al.
8,190,435 B2 5/2012 Wang et al.
8,234,111 B2 * 7/2012 Lloyd ..... G10L 15/20 704/231
8,364,483 B2 1/2013 Park et al.
2001/0001141 A1 * 5/2001 Sih ..... G10L 15/20 704/231
2002/0046022 A1 * 4/2002 Rose ..... G10L 15/20 704/231
2002/0087306 A1 * 7/2002 Lee ..... G06Q 30/06 704/233
2003/0033143 A1 * 2/2003 Aronowitz ..... G10L 15/20 704/233
2004/0138882 A1 * 7/2004 Miyazawa ..... G10L 15/065 704/233

(Continued)

OTHER PUBLICATIONS

Visser, E., et al., "Speech Enhancement in a Noisy Car Environment", Proceedings, Independent Component Analysis (ICA) International Workshop on Independent Component Analysis and Blind Signal Separation (ICA 2001), Dec. 2001, pp. 272-276, University of California, San Diego Institute for Neural Computation, USA.

(Continued)

*Primary Examiner* — Edgar Guerra-Erazo
(74) *Attorney, Agent, or Firm* — Brandon C. Kennedy; Katherine S. Brown; Kennedy Lenart Spraggins LLP

(57) ABSTRACT

Compensating for identifiable background content in a speech recognition device, including: receiving, by a noise filtering module, an identification of environmental audio data received by the speech recognition device; and filtering, by the noise filtering module in dependence upon which portion of the identified environmental audio data was being rendered when the audio data generated from the plurality of sources was received, the audio data generated from the plurality of sources.

18 Claims, 5 Drawing Sheets

(56) References Cited

U.S. PATENT DOCUMENTS

| | | | | |
|---|---|---|---|---|
| 2007/0033034 | A1* | 2/2007 | Yao | G10L 15/20 704/244 |
| 2008/0300871 | A1* | 12/2008 | Gilbert | G10L 15/20 704/233 |
| 2010/0088093 | A1* | 4/2010 | Lee | G10L 15/22 704/233 |
| 2010/0211693 | A1 | 8/2010 | Master et al. | |
| 2011/0022292 | A1* | 1/2011 | Shen | G10L 15/1815 701/532 |
| 2011/0300806 | A1* | 12/2011 | Lindahl | G10L 21/0208 455/63.1 |
| 2015/0228281 | A1* | 8/2015 | Raniere | G06F 3/167 704/275 |

OTHER PUBLICATIONS

Lee, S., et al., "Statistical Model-Based Noise Reduction Approach for Car Interior Applications to Speech Recognition", ETRI Journal, vol. 32, No. 5, Oct. 2010, pp. 801-809, Electronics and Telecommunications Research Institute, Daejeon, Rep. of Korea.

Shazam, "Welcome to Shazam", product overview, shazam.com (online), [accessed Jul. 2013], 1 page, URL: http://www.shazam.com/.

Liutkus, A., et al., "Adaptive Filtering for Music/Voice Separation Exploiting the Repeating Musical Structure", 2012 IEEE International Conference on Acoustics, Speech and Signal Processing (ICASSP), Mar. 2012, pp. 53-56, IEEE Xplore Digital Library, USA, DOI: 10.1109/ICASSP.2012.6287815.

Deng, L., et al., "Noise Robust Speech Recognition", Microsoft Research Project, microsoft.com (online), [accessed Jul. 2013], 2 pages, URL: http://research.microsoft.com/en-us/projects/robust/.

De La Torre, A., et al., "Speech Recognition Under Noise Conditions: Compensation Methods", in Robust Speech Recognition and Understanding, Jun. 2007, chapter 25, pp. 439-460, I-Tech Education and Publishing (online), URL: http://cdn.intechopen.com/pdfs/128/InTech-Speech_recognition_under_noise_conditions_compensation_methods.pdf.

Reisinger, D., "Apple Hit With Lawsuit Over Noise-Canceling Technology", cnet.com (online), Jul. 2012, 3 pages, URL: http://news.cnet.com/8301-13579_3-57469317-37/apple-hit-with-lawsuit-over-noise-canceling-technology/.

Fink, "Multi-Microphone Signal Acquisition for Speech Recognition Systems", fink.com (online), Dec. 1993, 12 pages, URL: http://www.fink.com/papers/ee586.html.

* cited by examiner

COMPENSATING FOR IDENTIFIABLE BACKGROUND CONTENT IN A SPEECH RECOGNITION DEVICE

BACKGROUND OF THE INVENTION

1. Field of the Invention

The field of the invention is data processing, or, more specifically, methods, apparatus, and products for compensating for identifiable background content in a speech recognition device.

2. Description Of Related Art

Modern computing devices, such as smartphones, can include a variety of capabilities for receiving user input. User input may be received through a physical keyboard, through a number pad, through a touchscreen display, and even through the use of voice commands issued by a user of the computing device. Using a voice operated device in noisy environments, however, can be difficult as background noise can interfere with the operation of the voice operated device. In particular, background noise that contains words (e.g., music) can confuse the voice operated device and limit the functionality of the voice operated device.

SUMMARY OF THE INVENTION

Methods, apparatuses, and products for compensating for identifiable background content in a speech recognition device, including: receiving, by a noise filtering module, an identification of environmental audio data received by the speech recognition device, wherein the environmental audio data is not generated by a user of the speech recognition device; and filtering, by the noise filtering module in dependence upon which portion of the identified environmental audio data was being rendered when the audio data generated from the plurality of sources was received, the audio data generated from the plurality of sources.

The foregoing and other objects, features and advantages of the invention will be apparent from the following more particular descriptions of example embodiments of the invention as illustrated in the accompanying drawings wherein like reference numbers generally represent like parts of example embodiments of the invention.

DETAILED DESCRIPTION OF EXAMPLE EMBODIMENTS

Figure 1:
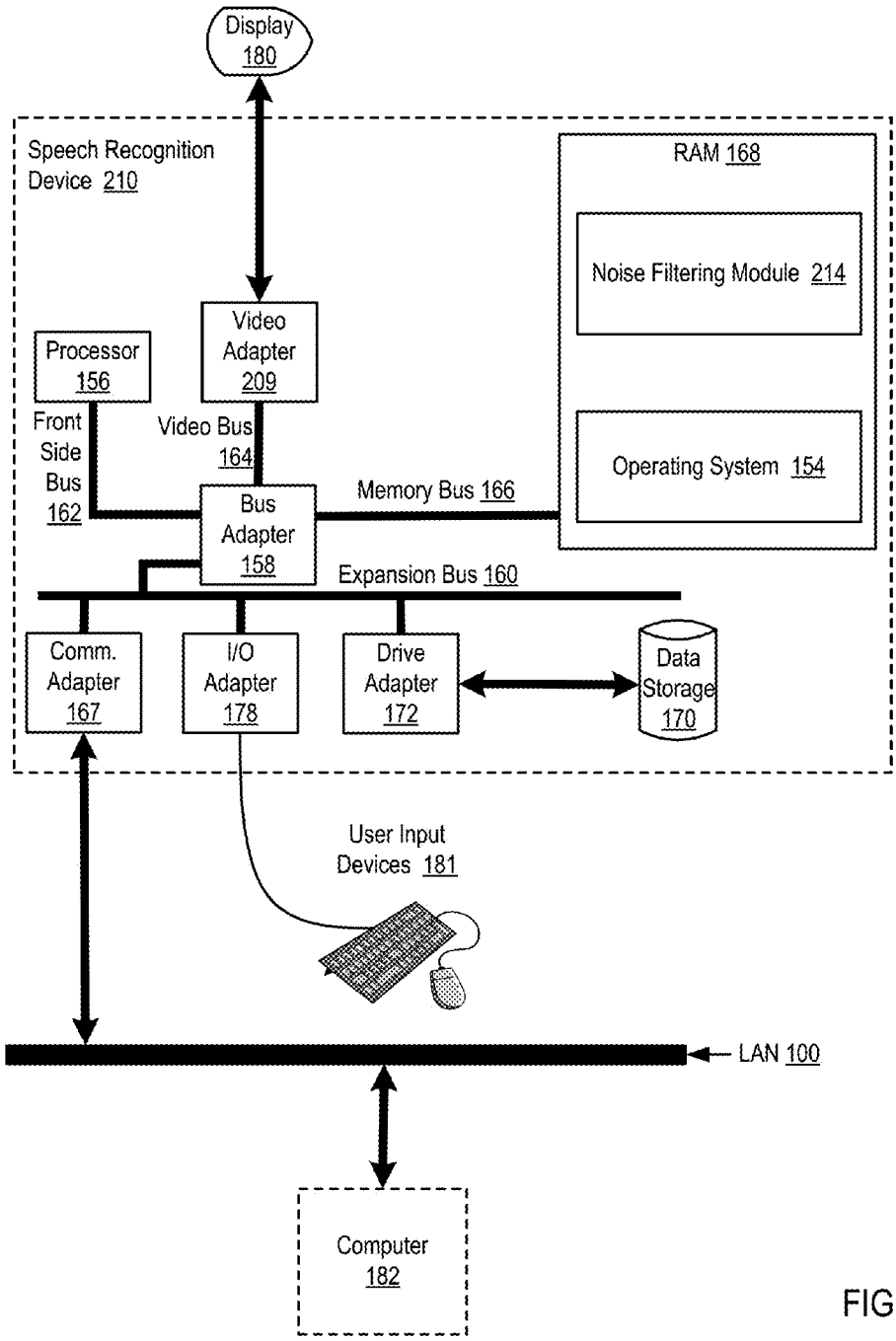
FIG. 1 sets forth a block diagram of automated computing machinery comprising an example speech recognition device useful in compensating for identifiable background content according to embodiments of the present invention.

Example methods, apparatus, and products for compensating for identifiable background content in a speech recognition device in accordance with the present invention are described with reference to the accompanying drawings, beginning with FIG. 1. FIG. 1 sets forth a block diagram of automated computing machinery comprising an example speech recognition device (210) useful in compensating for identifiable background content according to embodiments of the present invention. The speech recognition device (210) of FIG. 1 includes at least one computer processor (156) or 'CPU' as well as random access memory (168) ('RAM') which is connected through a high speed memory bus (166) and bus adapter (158) to processor (156) and to other components of the speech recognition device (210). The speech recognition device (210) depicted in FIG. 1 represents a device capable of receiving speech input from a user to perform some device function. The speech recognition device (210) of FIG. 1 may be embodied, for example, as a smartphone, as a portable media player, as a special purpose integrated system such as a navigation system in an automobile, and so on.

The speech recognition device (210) depicted in FIG. 1 can include a noise detection module (not shown) such as a microphone or other input device for detecting speech input in the form of audio data from a user. Readers will appreciate, however, that the noise detection module may also inadvertently detect audio data that is not generated by a user of the speech recognition device (210) depicted in FIG. 1. For example, the noise detection module may detect audio data generated by an audio data source such as a car stereo system, a portable media player, a stereo system over which music is played at a location where a user is utilizing the speech recognition device (210), and so on. The audio data received by the speech recognition device (210) can therefore include audio data that is not generated by a user as well as audio data that is generated by the user. Readers will appreciate that the audio data that is not generated by a user of the speech recognition device (210) can potentially interfere with the user's ability to utilize the voice command functionality of the speech recognition device (210), as only a portion of the entire audio data received by the speech recognition device (210) may be attributable to a user attempting to initiate a voice command.

Stored in RAM (168) is a noise filtering module (214), a module of computer program instructions for compensating for identifiable background content in a speech recognition device (210) according to embodiments of the present invention. The noise filtering module (214) may compensate for identifiable background content in a speech recognition device (210) by receiving, via an out-of-band communications link, an identification of environmental audio data that is not generated by a user of the speech recognition device (210). Receiving an identification of environmental audio data that is not generated by the user of the speech recognition device (210) may be carried out by the noise filtering module (214) continuously monitoring the environment surrounding the speech recognition device (210) for identifiable background content. In such an example, once environmental audio data that is not generated by the user of the speech recognition device (210) has been identified, an audio profile (e.g., a sound wave) for the environmental audio data may be identified and ultimately removed from the audio data sampled by the speech recognition device (210).

Consider an example in which the speech recognition device (210) is embodied as a smartphone located in an automobile where music is being played over the automobile's stereo system. In such an example, the music being played over the automobile's stereo system may interfere with the ability of the speech recognition device (210) to respond to user issued voice commands, as the speech recognition device (210) will detect a voice command from the user and will also detect environmental audio data from the automobile's stereo system when the user attempts to issue a voice command. The speech recognition device (210) may therefore be configured to continuously monitor the surrounding environment, for example, by utilizing a built-in microphone to gather a brief sample of the music being played by the automobile's stereo system. An acoustic profile may subsequently be created based on the brief sample and the acoustic profile may then be compared a central database for a match. In such a way, the noise filtering module (214) may determine an identification of the environmental audio data that is not generated by a user of the speech recognition device (210), such that the speech recognition device (210) can be aware of what background noise exists in the surrounding environment.

The noise filtering module (214) may further compensate for identifiable background content in a speech recognition device (210) by receiving audio data generated from a plurality of sources including the user of the speech recognition device (210). The audio data generated from a plurality of sources may include audio data generated by one or more audio data sources such as a car stereo system and audio data generated by the user of the speech recognition device (210). Receiving audio data generated from a plurality of sources including the user of the speech recognition device (210) may be carried out, for example, through the use of a noise detection module such as a microphone that is embedded within the speech recognition device (210). In such an example, the speech recognition device (210) may receive audio data generated from a plurality of sources by utilizing the microphone to convert sound into an electrical signal that is stored in memory of the speech recognition device (210). Because the noise detection module of the speech recognition device (210) will sample all sound in the environment surrounding the speech recognition device (210), voices commands issued by the user may not be discernable as the voice commands may only be an indistinguishable component of the audio data that is received by the noise filtering module (214).

The noise filtering module (214) may further compensate for identifiable background content in a speech recognition device (210) by determining which portion of the identified environmental audio data was being rendered when the audio data generated from the plurality of sources was received. The environmental audio data that is not generated by a user of the speech recognition device (210) may represent a known work (e.g., a song, a movie) with a known duration. In such an example, the acoustic profile of the environmental audio data that is not generated by a user of the speech recognition device (210) may therefore be very different at different points in time. Determining which portion of the identified environmental audio data was being rendered when the audio data generated from the plurality of sources was received may therefore be useful for determining the precise nature of the acoustic profile of the environmental audio data that is not generated by a user of the speech recognition device (210).

The noise filtering module (214) may further compensate for identifiable background content in a speech recognition device (210) by filtering, in dependence upon which portion of the identified environmental audio data was being rendered when the audio data generated from the plurality of sources was received, the audio data generated from the plurality of sources. Filtering the audio data generated from the plurality of sources may be carried out, for example, by retrieving an acoustic profile of audio data associated with the identification of the audio data that is not generated by the user of the speech recognition device. Upon retrieving an acoustic profile of audio data associated with the identification of the audio data that is not generated by the user of the speech recognition device (210), the acoustic profile of the audio data generated from the plurality of sources may be altered so as to remove the acoustic profile of audio data associated with the identification of the audio data that is not generated by the user of the speech recognition device (210).

Also stored in RAM (168) is an operating system (154). Operating systems useful compensating for identifiable background content in a speech recognition device according to embodiments of the present invention include UNIX™, Linux™, Microsoft Windows™, AIX™, IBM's i5/OS™, Apple's iOS™, Android™ OS, and others as will occur to those of skill in the art. The operating system (154) and the noise filtering module (214) in the example of FIG. 1 are shown in RAM (168), but many components of such software typically are stored in non-volatile memory also, such as, for example, on a disk drive (170).

The speech recognition device (210) of FIG. 1 includes disk drive adapter (172) coupled through expansion bus (160) and bus adapter (158) to processor (156) and other components of the speech recognition device (210). Disk drive adapter (172) connects non-volatile data storage to the speech recognition device (210) in the form of disk drive (170). Disk drive adapters useful in computers for compensating for identifiable background content in a speech recognition device according to embodiments of the present invention include Integrated Drive Electronics ('IDE') adapters, Small Computer System Interface ('SCSI') adapters, and others as will occur to those of skill in the art. Non-volatile computer memory also may be implemented for as an optical disk drive, electrically erasable programmable read-only memory (so-called 'EEPROM' or 'Flash' memory), RAM drives, and so on, as will occur to those of skill in the art.

The example speech recognition device (210) of FIG. 1 includes one or more input/output ('I/O') adapters (178). I/O adapters implement user-oriented input/output through, for example, software drivers and computer hardware for controlling output to display devices such as computer display screens, as well as user input from user input devices (181) such as keyboards and mice. The example speech recognition device (210) of FIG. 1 includes a video adapter (209), which is an example of an I/O adapter specially designed for graphic output to a display device (180) such as a display screen or computer monitor. Video adapter (209) is connected to processor (156) through a high speed video bus (164), bus adapter (158), and the front side bus (162), which is also a high speed bus.

The example speech recognition device (210) of FIG. 1 includes a communications adapter (167) for data communications with other computers (182) and for data communications with a data communications network (100). Such data communications may be carried out serially through RS-232 connections, through external buses such as a Universal Serial Bus ('USB'), through data communications networks such as IP data communications networks, through mobile communications networks, and in other ways as will occur to those of skill in the art. Communications adapters implement the hardware level of data communications through which one computer sends data communications to another computer, directly or through a data communications network. Examples of communications adapters useful for compensating for identifiable background content in a speech recognition device according to embodiments of the present invention include modems for wired dial-up communications, Ethernet (IEEE 802.3) adapters for wired data communications network communications, 802.11 adapters for wireless data communications network communications, adapters for wireless data communications over a long term evolution ('LTE') network, and so on.

Figure 2:
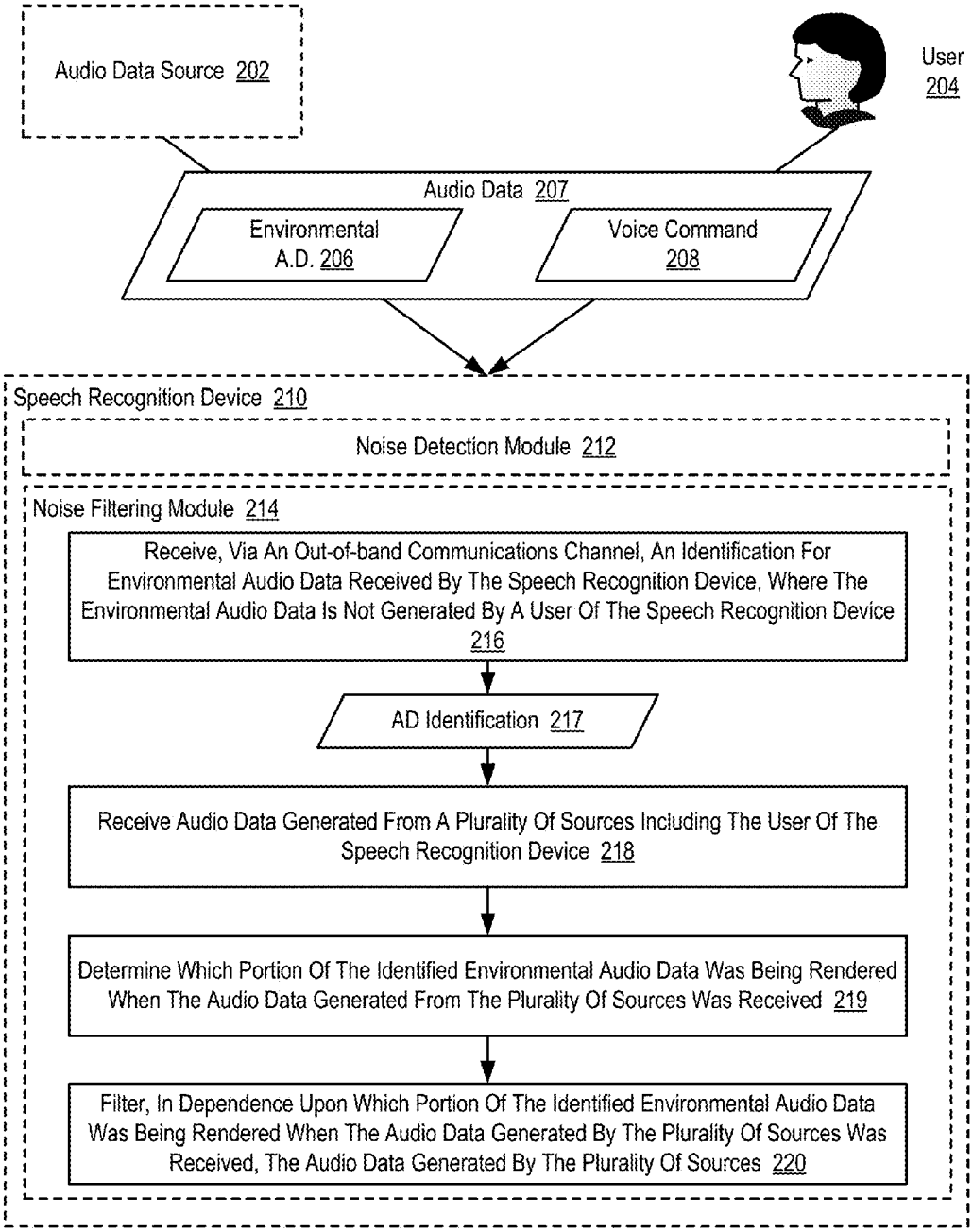
FIG. 2 sets forth a flow chart illustrating an example method for compensating for identifiable background content in a speech recognition device according to embodiments of the present invention.

For further explanation, FIG. 2 sets forth a flow chart illustrating an example method for compensating for identifiable background content in a speech recognition device (210) according to embodiments of the present invention. In the example method of FIG. 2, the speech recognition device (210) represents a device capable of receiving speech input from a user (204) to perform some device function. The speech recognition device (210) of FIG. 2 may be embodied, for example, as a smartphone, as a portable media player, as a special purpose integrated system such as a navigation system in an automobile, and so on.

The speech recognition device (210) of FIG. 2 can include a noise detection module (212) such as a microphone or other input device for detecting speech input in the form of a voice command (208) from a user (204). Readers will appreciate, however, that the noise detection module (212) may also inadvertently detect environmental audio data (206) that is not generated by a user (204) of the speech recognition device (210). For example, the noise detection module (212) may detect environmental audio data (206) generated by an audio data source (202) such as a car stereo system, a portable media player, a stereo system over which music is played at a location where a user (204) is utilizing the voice recognition device, and so on. The audio data (207) received by the speech recognition device (210) can therefore include a combination of a voice command (208) generated by the user (204) as well as environmental audio data (206) generated by an audio data source (202) other than the user (204). Readers will appreciate that the environmental audio data (206) that is not generated by a user (204) of the speech recognition device (210) can potentially interfere with the user's ability to utilize the voice command functionality of the speech recognition device (210), as only a portion of the entire audio data (207) received by the speech recognition device may be attributable to a user (204) attempting to initiate a voice command.

The example method depicted in FIG. 2 is carried out, at least in part, by a noise filtering module (214). The noise filtering module (214) depicted in FIG. 2 may be embodied, for example, as a module of computer program instructions executing on computer hardware such as a computer processor. The noise filtering module (214) may include special purpose computer program instructions designed to compensate for identifiable background content in a speech recognition device (210) according to embodiments of the present invention.

The example method depicted in FIG. 2 includes receiving (216), by the noise filtering module (214) via an out-of-band communications link, an identification of environmental audio data (206) that is not generated by a user (204) of the speech recognition device (210). In the example method of FIG. 2, receiving (216) an identification of environmental audio data (206) that is not generated by the user (204) of the speech recognition device (210) may be carried out by the noise filtering module (214) continuously monitoring the environment surrounding the speech recognition device (210) for identifiable background content. In such an example, once environmental audio data (206) that is not generated by the user (204) of the speech recognition device (210) has been identified, an audio profile (e.g., a sound wave) for the environmental audio data (206) may be identified and ultimately removed from the audio data (207) sampled by the speech recognition device (210).

Consider an example in which the speech recognition device (210) is embodied as a smartphone located in an automobile where music is being played over the automobile's stereo system. In such an example, the music being played over the automobile's stereo system may interfere with the ability of the speech recognition device (210) to respond to user issued voice commands, as the speech recognition device (210) will detect a voice command (208) from the user (204) and will also detect environmental audio data (206) from the automobile's stereo system when the user (204) attempts to issue a voice command. The speech recognition device (210) may therefore be configured to continuously monitor the surrounding environment, for example, by utilizing a built-in microphone to gather a brief sample of the music being played by the automobile's stereo system. An acoustic profile may subsequently be created based on the brief sample and the acoustic profile may then be compared a central database of acoustic profiles for a match. In such a way, the noise filtering module (214) may determine an identification (217) of the environmental audio data (206) that is not generated by a user (204) of the speech recognition device (210), such that the speech recognition device (210) can be aware of what background noise exists in the surrounding environment.

In the example method of FIG. 2, the identification of environmental audio data (206) that is not generated by a user (204) of the speech recognition device (210) may be received (216) via an out-of-band communications link. In the example method of FIG. 2, the an out-of-band communications link may be embodied, for example, as a Wi-Fi communications link between the speech recognition device (210) and the audio data source (202), as a link over a telecommunications network and a service that matches captured audio data to a repository of known audio works, as a predetermined and inaudible frequency over which the audio data source (202) and the speech recognition device (210) can communicate, and so on.

The example method depicted in FIG. 2 also includes receiving (218), by the noise filtering module (214), audio data (207) generated from a plurality of sources including the user (204) of the speech recognition device (210). In the example method of FIG. 2, the audio data (207) generated from a plurality of sources may include environmental audio data (206) generated by one or more audio data sources (202) such as a car stereo system and a voice command (208) generated by the user (204) of the speech recognition device (210). Receiving (218) audio data (207) generated from a plurality of sources including the user (204) of the speech recognition device (210) may be carried out, for example, through the use of a noise detection module (212) such as a microphone that is embedded within the speech recognition device (210). In such an example, the speech recognition device (210) may receive (218) audio data (207) generated from a plurality of sources by utilizing the microphone to convert sound into an electrical signal that is stored in memory of the speech recognition device (210). Because the noise detection module (212) of the speech recognition device (210) will sample all sound in the environment surrounding the speech recognition device (210), voices commands issued by the user (204) may not be discernable as the voice commands may only be an indistinguishable component of the audio data (207) that is received (218) by the noise filtering module (214).

The example method depicted in FIG. 2 also includes determining (219), by the noise filtering module (214), which portion of the identified environmental audio data (206) was being rendered when the audio data (207) generated from the plurality of sources was received (218). In the example method of FIG. 2, the environmental audio data (206) that is not generated by a user (204) of the speech recognition device (210) may represent a known work (e.g., a song, a movie) with a known duration. In such an example, the acoustic profile of the environmental audio data (206) that is not generated by a user (204) of the speech recognition device (210) may therefore be very different at different points in time. Determining (219) which portion of the identified environmental audio data (206) was being rendered when the audio data (207) generated from the plurality of sources was received (218) may therefore be useful for determining the precise nature of the acoustic profile of the environmental audio data (206) that is not generated by a user (204) of the speech recognition device (210).

In the example method of FIG. 2, determining (219) which portion of the identified environmental audio data (206) was being rendered when the audio data (207) generated from the plurality of sources was received (218) may be carried out in a variety of ways. For example, an audio data source (202) may communicate the duration of the environmental audio data (206) to the speech recognition device (210) when the audio data source (202) begins to render a particular song, movie, or other known work. In such a way, the speech recognition device (210) may determine (219) which portion of the identified environmental audio data (206) was being rendered when the audio data (207) generated from the plurality of sources was received (218) by comparing a time stamp identifying the audio data (207) generated from the plurality of sources was received (218) to a time stamp identifying when the audio data source (202) begins to render a particular song, movie, or other known work. In another example, the audio data source (202) may be configured to respond to a request received from the speech recognition device (210) for a timing position for the environmental audio data (206). In yet another example, a brief sample of the environmental audio data (206) may be collected by the speech recognition device (210) and compared to acoustic profiles in an audio data repository as described in more detail below. In such an example, the audio data repository may include information identifying the total duration of a particular entry, such that the noise filtering module (214) can determine which portion of the acoustic profile for a particular entry matches the sampled signal and correlate that portion of the acoustic profile to a timing position based on the total duration of the particular entry.

The example method depicted in FIG. 2 also includes filtering (220), by the noise filtering module (214) in dependence upon which portion of the identified environmental audio data (206) was being rendered when the audio data (207) generated from the plurality of sources was received (218), the audio data (207) generated from the plurality of sources. In the example method of FIG. 2, filtering (220) the audio data (207) generated from the plurality of sources may be carried out, for example, by retrieving an acoustic profile of the portion of the identified environmental audio data (206) that was being rendered when the audio data (207) generated from the plurality of sources was received (218). Upon retrieving an acoustic profile of the portion of the identified environmental audio data (206) that was being rendered when the audio data (207) generated from the plurality of sources was received (218), the acoustic profile of the audio data (207) generated from the plurality of sources may be altered so as to remove the acoustic profile of the portion of the identified environmental audio data (206) that was being rendered when the audio data (207) generated from the plurality of sources was received (218).

Filtering (220) the audio data (207) generated from the plurality of sources may be carried out, for example, through the use of a linear filter (not shown). In particular, the signal representing the audio data (207) generated from the plurality of sources may be deconstructed into a predetermined number of segments, deconstructed into segments of a predetermined duration, and so on. Likewise, a signal representing the environmental audio data (206) that is not generated by the user (204) of the speech recognition device (210) may also be deconstructed into segments that are identical in duration to the segments of the signal representing the audio data (207) generated from the plurality of sources. In such an example, a segment of the signal representing the audio data (207) generated from the plurality of sources is passed to the linear filter as one input and a corresponding segment of the signal representing the environmental audio data (206) that is not generated by the user (204) of the speech recognition device (210) is passed to the linear filter a second input. The linear filter may subsequently subtract the segment of the signal representing the environmental audio data (206) that is not generated by the user (204) of the speech recognition device (210) from the segment of the signal representing the audio data (207) generated from the plurality of sources, with the resultant signal representing a segment of a signal representing the voice command (208) from the user (204). By performing this process for each segment, a signal representing the voice command (208) from the user (204) can be produced.

Figure 3:
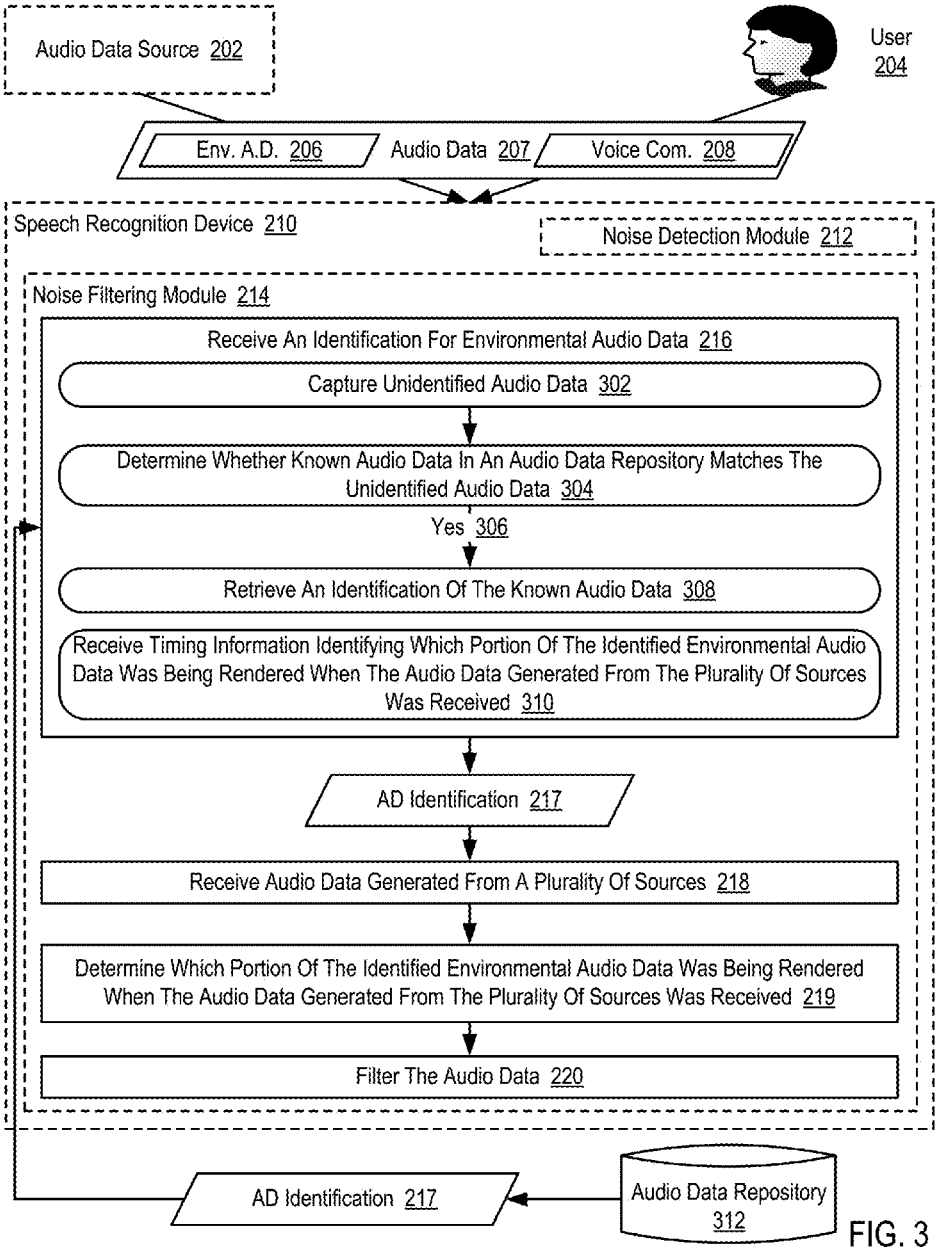
FIG. 3 sets forth a flow chart illustrating an additional example method for compensating for identifiable background content in a speech recognition device according to embodiments of the present invention.

For further explanation, FIG. 3 sets forth a flow chart illustrating an additional example method for compensating for identifiable background content in a speech recognition device (210) according to embodiments of the present invention. The example method depicted in FIG. 3 is similar to the example method depicted in FIG. 2, as it also includes receiving (216) an identification of environmental audio data (206) that is not generated by a user (204) of the speech recognition device (210), receiving (218) audio data (207) generated from a plurality of sources including the user (204) of the speech recognition device (210), determining (219) which portion of the identified environmental audio data (206) was being rendered when the audio data (207) generated from the plurality of sources was received (218), and filtering (220) the audio data (207) generated from the plurality of sources in dependence upon which portion of the identified environmental audio data (206) was being rendered when the audio data (207) generated from the plurality of sources was received (218).

In the example method depicted in FIG. 3, receiving (216) an identification of environmental audio data (206) that is not generated by a user (204) of the speech recognition device (210) can include capturing (302), by the noise filtering module (214), unidentified audio data. In the example method of FIG. 3, capturing (302) unidentified audio data may be carried out through the use of a microphone or other sensor that is capable of capturing sound and converting the captured sound into an electrical signal. The speech recognition device (210) of FIG. 3 may be configured to periodically capture (302) unidentified audio data by periodically recording sound, such that audio data is captured even when the user (204) of the speech recognition device (210) is not issuing a voice command or otherwise vocally interacting with the speech recognition device (210).

In the example method depicted in FIG. 3, receiving (216) an identification of environmental audio data (206) that is not generated by a user (204) of the speech recognition device (210) can also include determining (304), by the noise filtering module (214), whether known audio data in an audio data repository (312) matches the unidentified audio data captured (302) above. The audio data repository (312) may be embodied as a database or other repository for storing the audio profiles for known works. The audio data repository (312) may include, for example, audio profiles associated with a plurality of songs. Such audio profiles can include a resultant sound wave generated by playing a particular song or other information that represents a quantifiable characterization of the sound that is generated by the particular song. In the example method of FIG. 3, determining (304) whether known audio data in an audio data repository (312) matches the unidentified audio data may be carried out by comparing an audio profile for the unidentified audio data to each of the audio profiles stored in the audio data repository (312) to determine whether a match exists within a predetermined acceptable threshold.

In the example method depicted in FIG. 3, receiving (216) an identification of environmental audio data (206) that is not generated by a user (204) of the speech recognition device (210) can also include retrieving (308), by the noise filtering module (214), an identification of the known audio data from the audio data repository (312). In the example method of FIG. 3, retrieving (308) an identification of the known audio data may be carried out by retrieving an identifier that is associated with a known audio profile in the audio data repository (312) that matches the audio profile of the environmental audio data (206) that is not generated by a user (204) of the speech recognition device (210). In the example method of FIG. 3, retrieving (308) an identification of the known audio data is carried out in response to affirmatively (306) determining that known audio data in the audio data repository (312) matches the unidentified audio data captured (302) above.

In the example method depicted in FIG. 3, receiving (216) an identification of environmental audio data (206) that is not generated by a user (204) of the speech recognition device (210) can alternatively include receiving (310), by the noise filtering module (214), timing information identifying which portion of the identified environmental audio data (206) was being rendered when the audio data (207) generated from the plurality of sources was received. For example, an audio data source (202) may be configured to respond to a request received from the speech recognition device (210) for a timing position for the environmental audio data (206).

Figure 4:
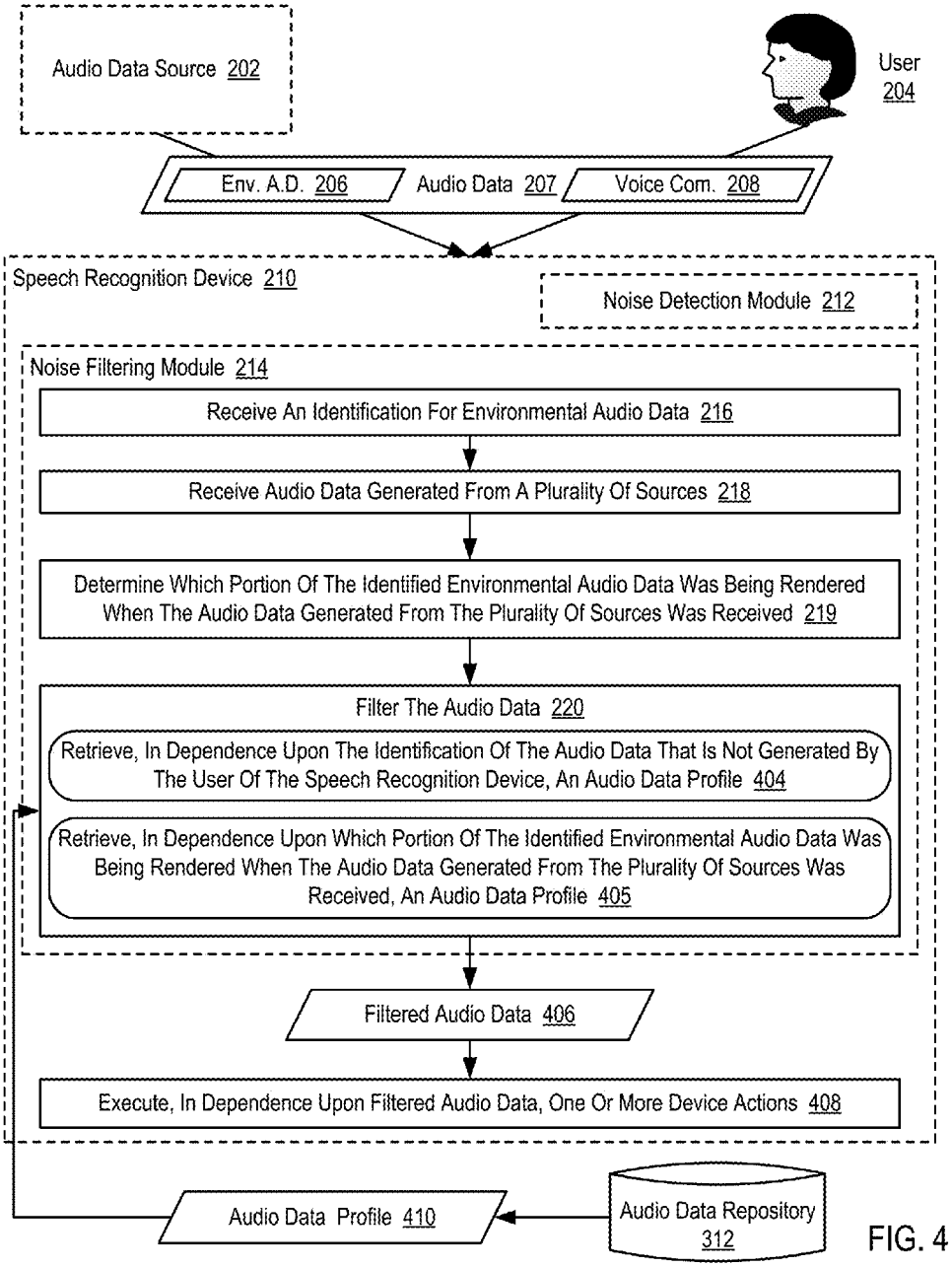
FIG. 4 sets forth a flow chart illustrating an additional example method for compensating for identifiable background content in a speech recognition device according to embodiments of the present invention.

For further explanation, FIG. 4 sets forth a flow chart illustrating an additional example method for compensating for identifiable background content in a speech recognition device (210) according to embodiments of the present invention. The example method depicted in FIG. 4 is similar to the example method depicted in FIG. 2, as it also includes receiving (216) an identification of environmental audio data (206) that is not generated by a user (204) of the speech recognition device (210), receiving (218) audio data (207) generated from a plurality of sources including the user (204) of the speech recognition device (210), determining (219) which portion of the identified environmental audio data (206) was being rendered when the audio data (207) generated from the plurality of sources was received (218), and filtering (220) the audio data (207) generated from the plurality of sources in dependence upon which portion of the identified environmental audio data (206) was being rendered when the audio data (207) generated from the plurality of sources was received (218).

In the example method of FIG. 4, filtering (220) the audio data (207) generated from the plurality of sources can include retrieving (404), by the noise filtering module (214) in dependence upon the identification (217 of FIG. 2) of the environmental audio data (206) that is not generated by the user (204) of the speech recognition device (210), an audio data profile (410). In the example method of FIG. 4, each entry in the audio data repository (312) may include audio data profile (410) that is associated an identifier of some audio content. The audio data profile (410) may include, for example, a representation of the sound wave that is generated by rendering some particular audio content. In such an example, retrieving (404) an audio data profile (410) for the environmental audio data (206) that is not generated by the user (204) of the speech recognition device (210) may be carried out by performing a lookup operation in the audio data repository (312) using the identification (217 of FIG. 2) of the environmental audio data (206) that is not generated by the user (204) of the speech recognition device (210). The audio data profile (410) may subsequently be utilized to filter (220) the audio data (207) generated from the plurality of sources.

In the example method of FIG. 4, filtering (220) the audio data (207) generated from the plurality of sources can alternatively include retrieving (405), by the noise filtering module (214) in dependence upon which portion of the identified environmental audio data (206) was being rendered when the audio data (207) generated from the plurality of sources was received (218), an audio data profile (410) for the identified environmental audio data (206). In the example method of FIG. 4, each entry in the audio data repository (312) may include audio data profile (410) that is associated an identifier of some audio content. The audio data profile (410) may include, for example, a representation of the sound wave that is generated by rendering some particular audio content. In such an example, retrieving (405) an audio data profile (410) for the audio data (206) that is not generated by the user (204) of the speech recognition device (210) may be carried out by performing a lookup operation in the audio data repository (312) using the identification (217 of FIG. 2) of the environmental audio data (206) that is not generated by the user (204) of the speech recognition device (210) and extracting the portion of the audio data profile (410) that corresponds to portion of the identified environmental audio data (206) was being rendered when the audio data (207) generated from the plurality of sources was received (218). The audio data profile (410) may subsequently be utilized to filter (220) the audio data (207) generated from the plurality of sources.

The example method depicted in FIG. 4 also includes executing (408), by the speech recognition device (210) in dependence upon filtered audio data (406), one or more device actions. In the example method of FIG. 4, the speech recognition device (210) may utilize a natural language user interface configured to parse natural language received from a user (204), determine the meaning on the natural language received from a user (204), and carry out some action that is associated the determined meaning of the natural language received from the user (204).

Figure 5:
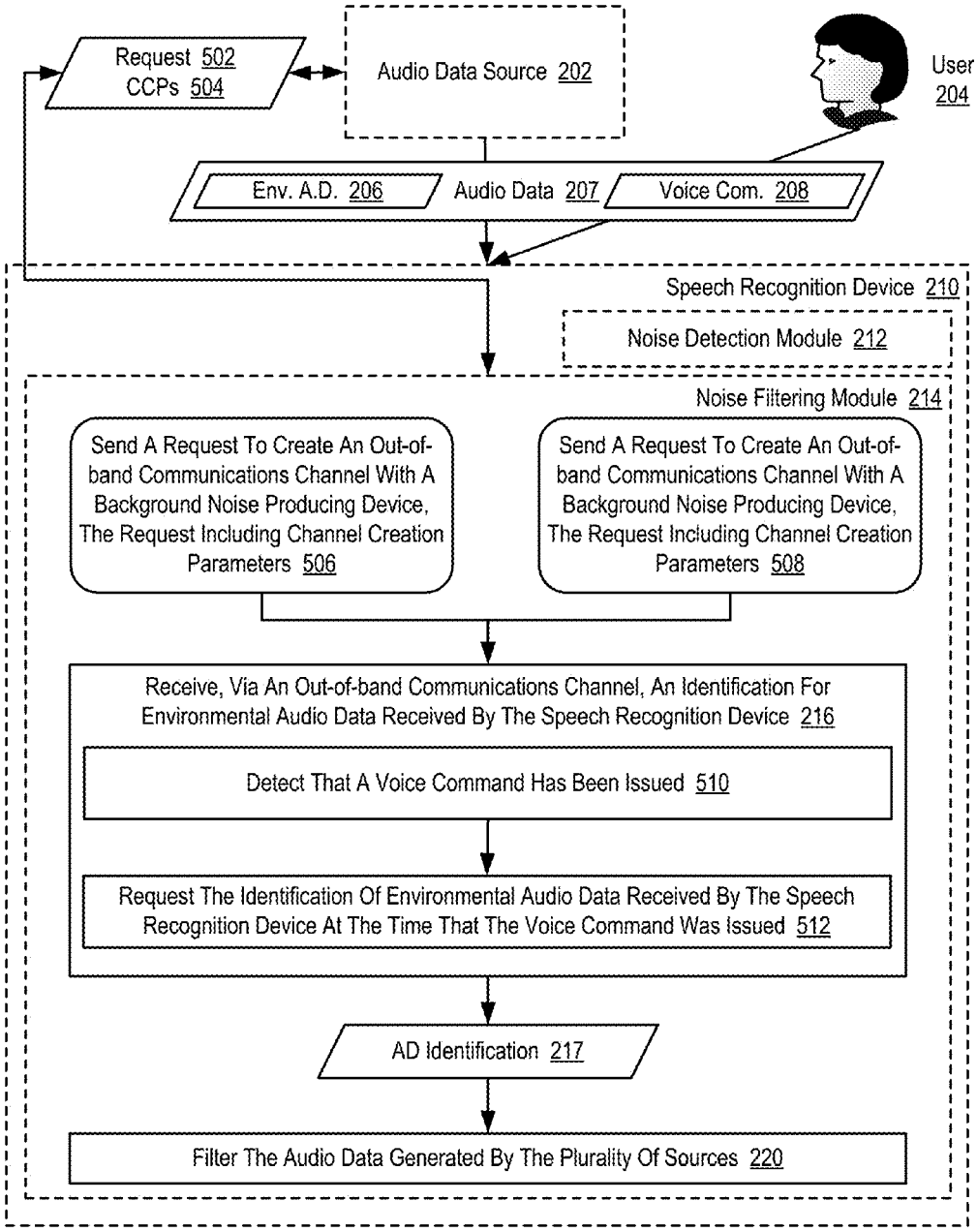
FIG. 5 sets forth a flow chart illustrating an additional example method for compensating for identifiable background content in a speech recognition device according to embodiments of the present invention.

For further explanation, FIG. 5 sets forth a flow chart illustrating an additional example method for compensating for identifiable background content in a speech recognition device (210) according to embodiments of the present invention. The example method depicted in FIG. 5 is similar to the example method depicted in FIG. 2, as it also includes receiving (216) an identification of environmental audio data (206) that is not generated by a user (204) of the speech recognition device (210) and filtering (220) the audio data (207) generated from the plurality of sources in dependence upon which portion of the identified environmental audio data (206) was being rendered when the audio data (207) generated from the plurality of sources was received (218).

The example method depicted in FIG. 5 also includes sending (506), by the noise filtering module (214), a request (502) to create an out-of-band communications channel with a background noise producing device such as audio data source (202). In the example method depicted in FIG. 5, the request (502) includes channel creation parameters (504). The channel creation parameters (504) can include information identifying the type of data communications channel to be created between the speech recognition device (210) and an external audio data source (202). For example, the channel creation parameters (504) may indicate that the data communications channel to be created between the speech recognition device (210) and an external audio data source (202) should be embodied as a BlueTooth connection to utilize BlueTooth capabilities of the speech recognition device (210) and the audio data source (202). Alternatively, the channel creation parameters (504) may indicate that the data communications channel to be created between the speech recognition device (210) and an external audio data source (202) should be embodied as an inaudible spectrum frequency that the audio data source (202) may use to send information to the speech recognition device (210). In addition, the channel creation parameters (504) may indicate that the data communications channel to be created between the speech recognition device (210) and an external audio data source (202) should be embodied as WiFi connection over which the audio data source (202) may send information to an IP address associated with the speech recognition device (210).

The example method depicted in FIG. 5 also includes receiving (508), by the noise filtering module (202) from a background noise producing device such as audio data source (202), a request (502) to create an out-of-band communications channel. Readers will appreciate that either the speech recognition device (210) or the audio data source (202) may initiate data communications with each other in view of the fact that the request (502) can be sent (506) by the noise filtering module (214) or received (508) by the noise filtering module (214). In such an example, the noise filtering module (214) may simply broadcast such a request (502) for receipt by any audio data source (202) as part of a discovery process, the noise filtering module (214) may listen for such a request (502) from any audio data source (202), the speech recognition device (210) may be configured with information useful in directing the request (502) to a particular audio data source (202), and so on.

In the example method depicted in FIG. 5, receiving (216) an identification (217) of environmental audio data (206) that is not generated by a user (204) of the speech recognition device (210) can include detecting (510), by the noise filtering module (214), that a voice command has been issued by the user (204) of the speech recognition device (210). In the example method of FIG. 5, detecting (510) that a voice command has been issued by the user (204) of the speech recognition device (210) may be carried out, for example, through the use of a noise detection module (212) such as a microphone. The speech recognition device (210) of FIG. 5 may be configured to listen for a voice command, for example, in response to a user (204) of the speech recognition device (210) activating a speech recognition application on the speech recognition device (210).

In the example method depicted in FIG. 5, receiving (216) an identification (217) of environmental audio data (206) that is not generated by a user (204) of the speech recognition device (210) can further include requesting (512), by the noise filtering module (214), the identification (217) of environmental audio data received by the speech recognition device (210) at the time that the voice command was issued. In the example method depicted in FIG. 5, requesting (512) the identification (217) of environmental audio data received by the speech recognition device (210) at the time that the voice command was issued is carried out in response to detecting (510) that the voice command has been issued.

In the example method of FIG. 5, requesting (512) the identification (217) of environmental audio data received by the speech recognition device (210) at the time that the voice command was issued may be carried out by sending a request for background noise identification over an established communications channel. In such an example, the request for background noise identification may include timing information such as a timestamp identifying the time during which the voice command was received by the speech recognition device (210), a value indicating a relative time position (e.g., the voice command was received 0.2 seconds prior to sending the request for background noise identification), and so on. In such an example, requesting (512) the identification (217) of environmental audio data received by the speech recognition device (210) at the time that the voice command was issued may enable the speech recognition device to receive timing information that is useful in filtering (220) the audio data (207) generated from the plurality of sources as described above with reference to FIGS. 2-4.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method of compensating for identifiable background content in a speech recognition device, the method comprising:

receiving, by a noise filtering module via an out-of-band communications channel, an identification of environmental audio data received by the speech recognition device, wherein the environmental audio data is not generated by a user of the speech recognition device; and filtering, by the noise filtering module in dependence upon which portion of the identified environmental audio data was being rendered when audio data generated by a plurality of sources was received, the audio data generated by the plurality of sources.

2. The method of claim 1 further comprising sending, by the noise filtering module, a request to create an out-of-band communications channel with a background noise producing device, the request including channel creation parameters.

3. The method of claim 1 further comprising receiving, by the noise filtering module from a background noise producing device, a request to create an out-of-band communications channel, the request including channel creation parameters.

4. The method of claim 1 wherein receiving, by the noise filtering module via an out-of-band communications link, an identification of environmental audio data received by the speech recognition device further comprises receiving timing information identifying which portion of the identified environmental audio data was being rendered when the audio data generated from the plurality of sources was received.

5. The method of claim 1 wherein receiving, by the noise filtering module via an out-of-band communications channel, the identification of environmental audio data received by the speech recognition device further comprises:

detecting, by the noise filtering module, that a voice command has been issued; and responsive to detecting that the voice command has been issued, requesting, by the noise filtering module, the identification of environmental audio data received by the speech recognition device at the time that the voice command was issued.

6. The method of claim 1 further comprising executing, by the speech recognition device in dependence upon filtered audio data, one or more device actions.

7. An apparatus for compensating for identifiable background content in a speech recognition device, the apparatus comprising a computer processor, a computer memory operatively coupled to the computer processor, the computer memory having disposed within it computer program instructions that, when executed by the computer processor, cause the apparatus to carry out the steps of:

receiving, by a noise filtering module via an out-of-band communications channel, an identification of environmental audio data received by the speech recognition device, wherein the environmental audio data is not generated by a user of the speech recognition device; and filtering, by the noise filtering module in dependence upon which portion of the identified environmental audio data was being rendered when audio data generated by a plurality of sources was received, the audio data generated by the plurality of sources.

8. The apparatus of claim 7 further comprising computer program instructions that, when executed by the computer processor, cause the apparatus to carry out the step of sending, by the noise filtering module, a request to create an out-of-band communications channel with a background noise producing device, the request including channel creation parameters.

9. The apparatus of claim 7 further comprising computer program instructions that, when executed by the computer processor, cause the apparatus to carry out the step of receiving, by the noise filtering module from a background noise producing device, a request to create an out-of-band communications channel, the request including channel creation parameters.

10. The apparatus of claim 7 wherein receiving, by the noise filtering module via an out-of-band communications link, an identification of environmental audio data received by the speech recognition device further comprises receiving timing information identifying which portion of the identified environmental audio data was being rendered when the audio data generated from the plurality of sources was received.

11. The apparatus of claim 7 wherein receiving, by the noise filtering module via an out-of-band communications channel, the identification of environmental audio data received by the speech recognition device further comprises:

detecting, by the noise filtering module, that a voice command has been issued; and responsive to detecting that the voice command has been issued, requesting, by the noise filtering module, the identification of environmental audio data received by the speech recognition device at the time that the voice command was issued.

12. The apparatus of claim 7 further comprising computer program instructions that, when executed by the computer processor, cause the apparatus to carry out the step of executing, by the speech recognition device in dependence upon filtered audio data, one or more device actions.

13. A computer program product for compensating for identifiable background content in a speech recognition device, the computer program product disposed upon a computer readable storage medium, wherein the computer readable storage medium is not a propagating signal, the computer program product comprising computer program instructions that, when executed, cause a computer to carry out the steps of:

receiving, by a noise filtering module via an out-of-band communications channel, an identification of environmental audio data received by the speech recognition device, wherein the environmental audio data is not generated by a user of the speech recognition device; and filtering, by the noise filtering module in dependence upon which portion of the identified environmental audio data was being rendered when audio data generated by a plurality of sources was received, the audio data generated by the plurality of sources.

14. The computer program product of claim 13 further comprising computer program instructions that, when executed, cause the computer to carry out the step of sending, by the noise filtering module, a request to create an out-of-band communications channel with a background noise producing device, the request including channel creation parameters.

15. The computer program product of claim 13 further comprising computer program instructions that, when executed, cause the computer to carry out the step of receiving, by the noise filtering module from a background noise producing device, a request to create an out-of-band communications channel, the request including channel creation parameters.

16. The computer program product of claim 13 wherein receiving, by the noise filtering module via an out-of-band communications link, an identification of environmental audio data received by the speech recognition device further comprises receiving timing information identifying which portion of the identified environmental audio data was being rendered when the audio data generated from the plurality of sources was received.

17. The computer program product of claim 13 wherein receiving, by the noise filtering module via an out-of-band communications channel, the identification of environmental audio data received by the speech recognition device further comprises:

detecting, by the noise filtering module, that a voice command has been issued; and responsive to detecting that the voice command has been issued, requesting, by the noise filtering module, the identification of environmental audio data received by the speech recognition device at the time that the voice command was issued.

18. The computer program product of claim 13 further comprising computer program instructions that, when executed, cause the computer to carry out the step of executing, by the speech recognition device in dependence upon filtered audio data, one or more device actions.

* * * * *